US005438715A

United States Patent [19]

Jackman

[11] Patent Number: 5,438,715

[45] Date of Patent: Aug. 8, 1995

[54] LOUNGER FOR PREGNANT WOMEN

[76] Inventor: Royd A. Jackman, 443 S. Maple St., Ames, Iowa 50010

[21] Appl. No.: 260,242

[22] Filed: Jun. 14, 1994

[51] Int. Cl.[6] ..... A47C 17/66; A47C 27/00

[52] U.S. Cl. ..... 5/110; 5/462; 5/930

[58] Field of Search ..... 5/462, 464, 930, 630, 5/631, 632, 617, 111, 112, 114, 463, 110; 247/118

[56] References Cited

U.S. PATENT DOCUMENTS

| | | | |
|---|---|---|---|
| 1,054,452 | 2/1913 | Sayen | 5/463 |
| 2,089,854 | 10/1937 | Pellegrini | 5/930 |
| 2,701,882 | 2/1955 | Parsons | 5/463 |
| 3,464,069 | 9/1969 | Bien | 5/930 |
| 4,021,872 | 5/1977 | Powell | 5/462 |
| 4,921,301 | 5/1990 | Haynes | 5/930 |
| 4,973,034 | 11/1990 | Michelé | 5/631 |
| 5,029,349 | 7/1991 | Hamilton | 5/631 |
| 5,185,897 | 2/1993 | Van Laanen | 5/930 |

*Primary Examiner*—Alexander Grosz

[57] ABSTRACT

A new and improved jack relax relief lounger having a first frame assembly, a second frame assembly, and a third frame assembly together forming a frame component. A support pad is secured to the frame component. The support pad has a circular recess therethrough. A reinforcing element surrounds the circular recess. A pad cover is dimensioned to be received within the circular recess of the support pad to provide a flat surface.

2 Claims, 4 Drawing Sheets

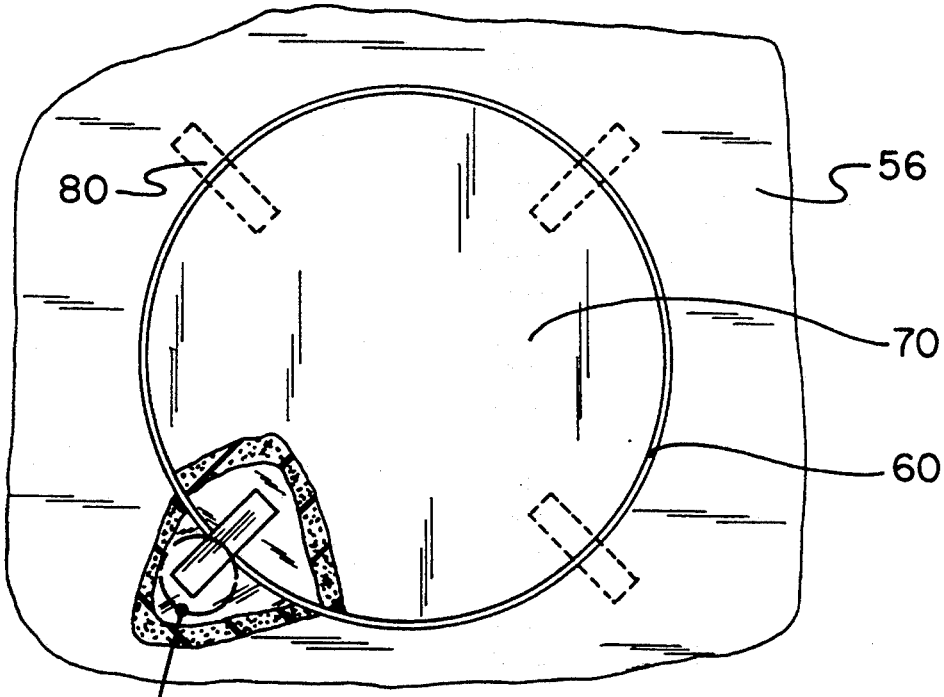
FIG. 5
FIG. 5A
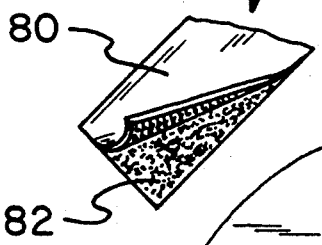
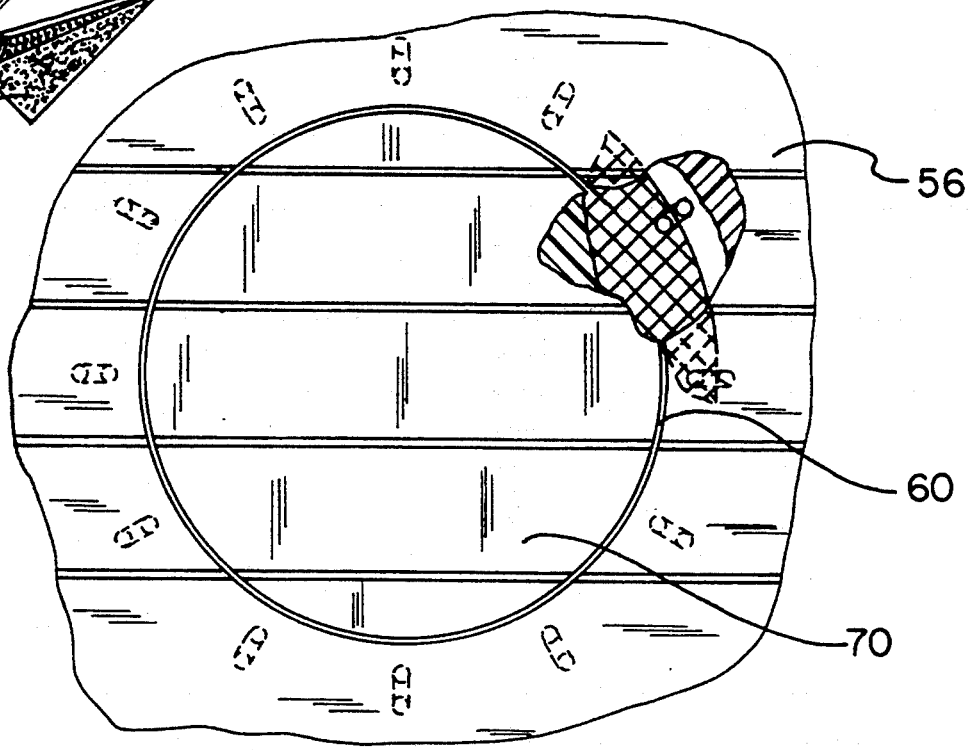
FIG. 6

LOUNGER FOR PREGNANT WOMEN

BACKGROUND OF THE INVENTION

1. Field of the Invention

The present invention relates to a jack relax relief lounger and more particularly pertains to providing the safest and most comfortable lounger for pregnant women with a jack relax relief lounger.

2. Description of the Prior Art

The use of adjustable mattresses is known in the prior art. More specifically, adjustable mattresses heretofore devised and utilized for the purpose of sleeping aides for pregnant woman are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,840,920 to Voelker discloses an adjustable mattress for pregnant mothers.

U.S. Pat. No. 4,051,566 to Esquivel discloses a mattress with modifiable cavity for pregnant women.

U.S. Pat. No. 4,973,034 to Michele discloses a massage table.

U.S. Pat. No. 5,029,349 to Hamilton discloses a pregnancy supporting chair assembly.

U.S. Pat. No. 5,185,897 to Van Laanen discloses an inflatable maternity mattress.

While these devices fulfill their respective, particular objective and requirements, the aforementioned patents do not describe a jack relax relief lounger that provides the safest and most comfortable lounger for pregnant women.

In this respect, the jack relax relief lounger according to the present invention substantially departs from the conventional concepts and designs of the prior art, and in doing so provides an apparatus primarily developed for the purpose of providing the safest and most comfortable lounger for pregnant women.

Therefore, it can be appreciated that there exists a continuing need for a new and improved jack relax relief lounger which can be used for providing the safest and most comfortable lounger for pregnant women. In this regard, the present invention substantially fulfills this need.

SUMMARY OF THE INVENTION

In the view of the foregoing disadvantages inherent in the known types of adjustable mattresses now present in the prior art, the present invention provides an improved jack relax relief lounger. As such, the general purpose of the present invention, which will be described subsequently in greater detail, is to provide a new and improved jack relax relief lounger and method which has all the advantages of the prior art and none of the disadvantages.

To attain this, the present invention essentially comprises a first frame assembly having a first end, a second end, an intermediate extent therebetween, a lower surface, and an upper surface. A set of legs are integral with both the lower surface of the first end and the lower surface of the second end. A set of handles are integral with the upper surface of the intermediate extent. A first frame extension is integral with the first end of the first frame assembly. The extension has a right support, a left support, and an intermediate support therebetween. The device contains a second frame assembly having a first end, a second end, and an intermediate extent therebetween. The first end is pivotally secured to the first end of the first frame assembly. The device also contains a third frame assembly having a first end, a second end, and an intermediate extent therebetween. The first end is pivotally secured to the intermediate extent of the second frame assembly. A plurality of grooves are along the intermediate extent. The grooves optionally couple the third frame assembly to the intermediate support of the first frame assembly. The first frame assembly, the second frame assembly, and the third frame assembly together form a frame component. A support pad is secured to the frame component. The support pad has a circular recess therethrough. A reinforcing element surrounds the circular recess. The device contains a plurality of hooks each having a first end and a hooked second end. Each first end is secured to the reinforcing element of the circular recess of the support pad. A circular mesh support pouch is removably secured to each second hooked end of the plurality of hooks. A pad cover is dimensioned to be received within the circular recess of the support pad and provide a flat surface. The device contains a head rest having a plurality of straps secured to the second end of the second fame assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jack relax relief lounger which has all the advantages of the prior art adjustable mattresses and none of the disadvantages.

It is another object of the present invention to provide a new and improved jack relax relief lounger which may be easily and efficiently manufactured and marketed.

It is a further object of the present invention to provide a new and improved jack relax relief lounger which is of durable and reliable construction.

An even further object of the present invention is to provide a new and improved jack relax relief lounger which is susceptible of a low cost of manufacture with regard to both materials and labor, and which accordingly is then susceptible of low prices of sale to the consuming public, thereby making such a jack relax relief lounger economically available to the buying public.

Still yet another object of the present invention is to provide a new and improved jack relax relief lounger which provides in the apparatuses and methods of the prior art some of the advantages thereof, while simultaneously overcoming some of the disadvantages normally associated therewith.

Even still another object of the present invention is to provide a new and improved jack relax relief lounger for providing the safest and most comfortable lounger for pregnant women.

Lastly, it is an object of the present invention to provide a new and improved jack relax relief lounger having a first frame assembly, a second frame assembly, and a third frame assembly together forming a frame component. A support pad is secured to the frame component. The support pad has a circular recess therethrough. A reinforcing element surrounds the circular recess. A pad cover is dimensioned to be received within the circular recess of the support pad to provide a flat surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a sectional plan view taken along line 5—5 of FIG. 2.

FIG. 6 is a cross-sectional view taken along line 6—6 of FIG. 2.

The same reference numerals refer to the same parts through the various Figures.

DESCRIPTION OF THE PREFERRED EMBODIMENT

Figure 1:
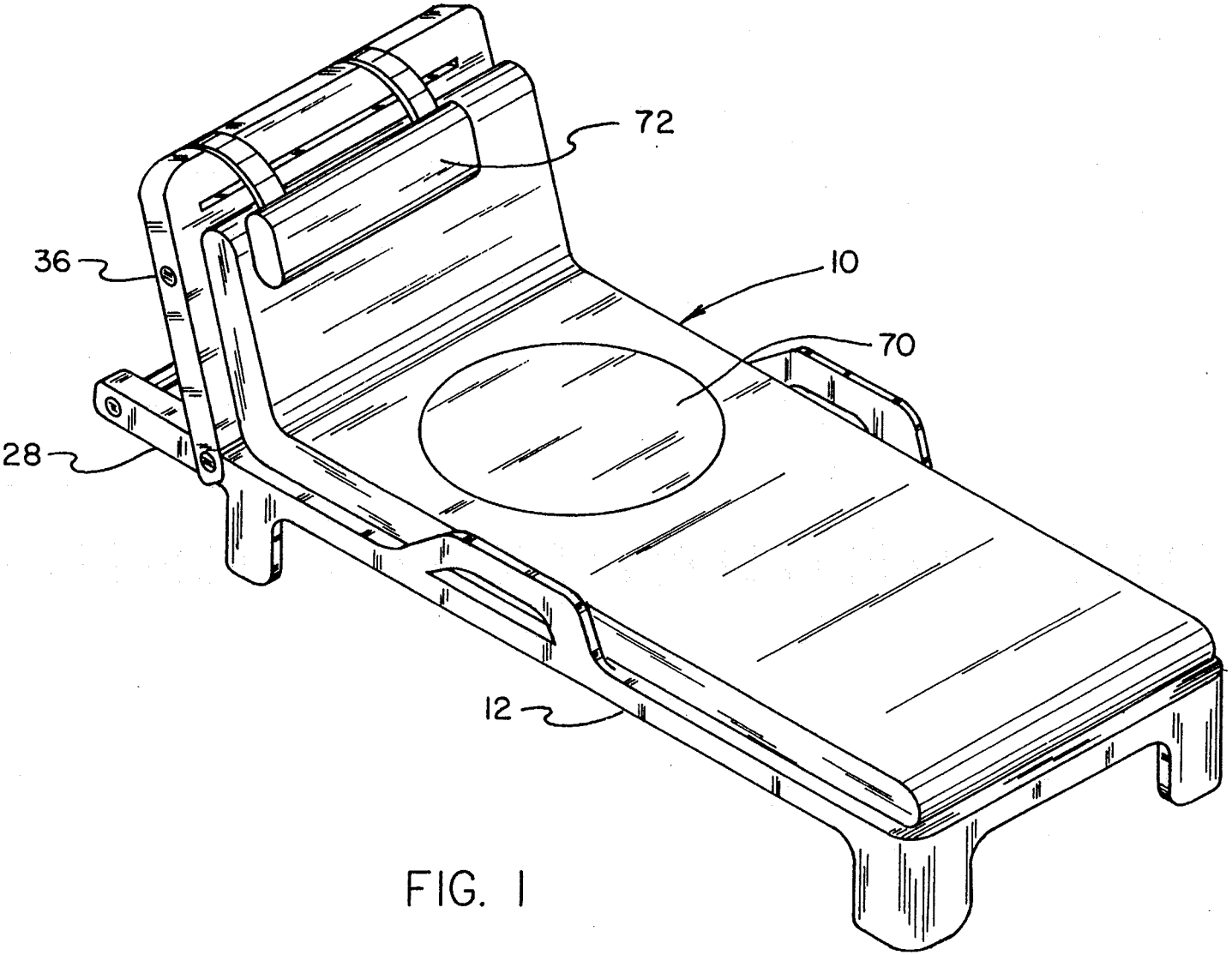
FIG. 1 is a perspective view of the preferred embodiment of the jack relax relief lounger constructed in accordance with the principles of the present invention.
Figure 2:
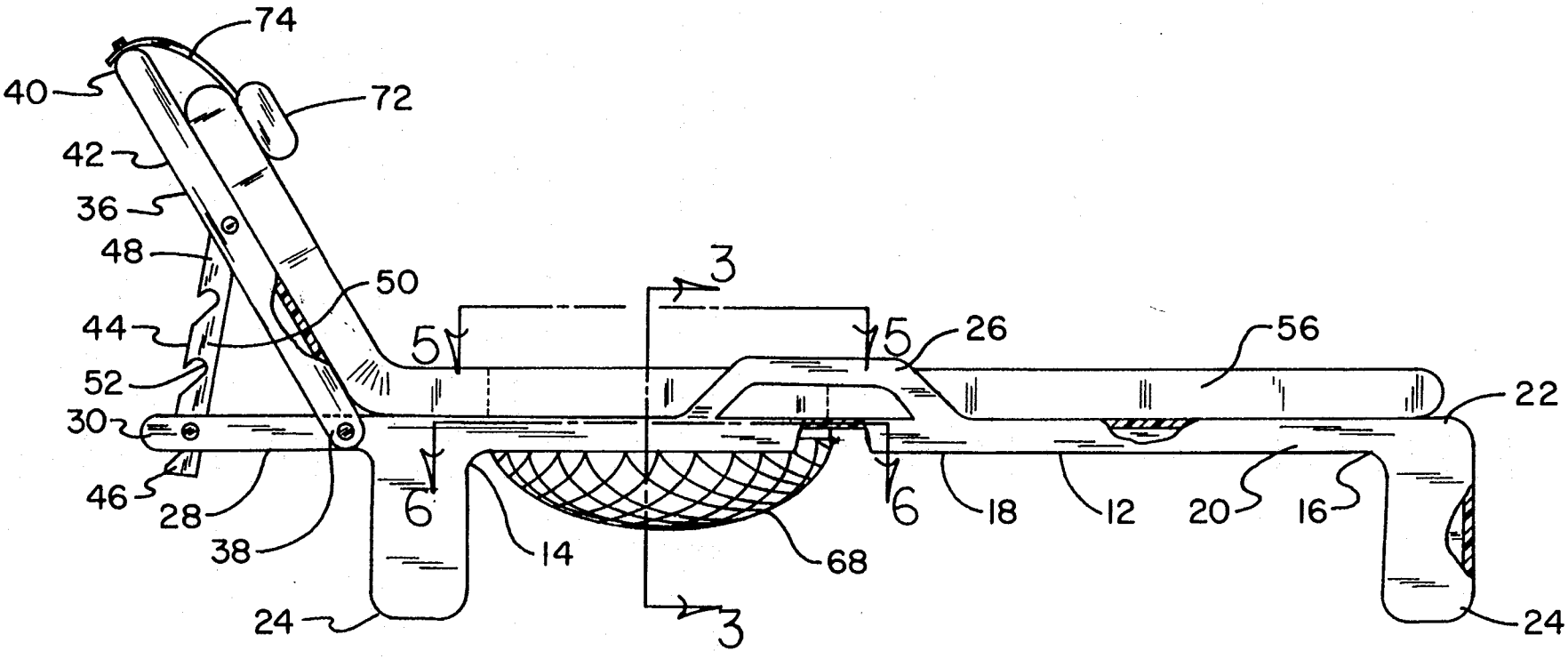
FIG. 2 is a side view of the preferred embodiment of the present invention.
Figure 3:
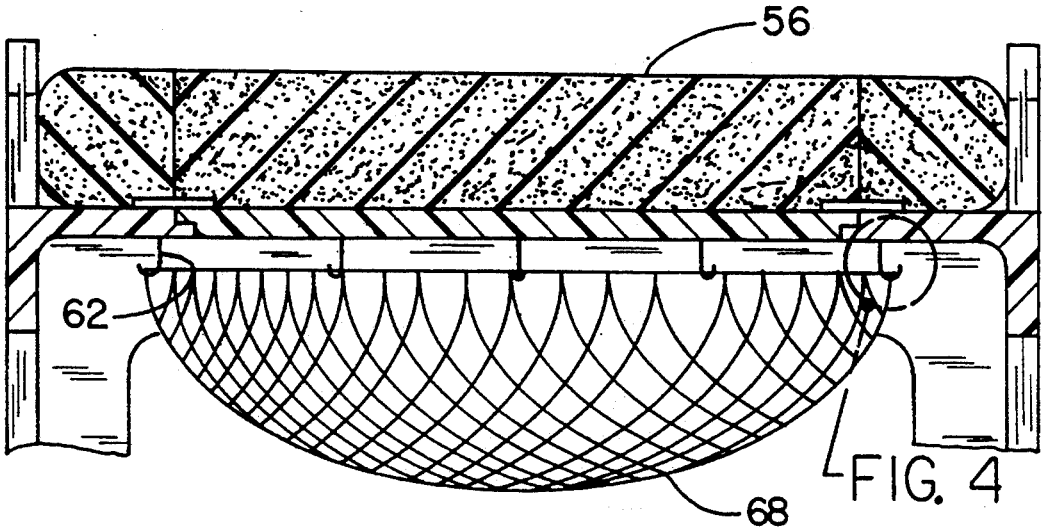
FIG. 3 is a cross-sectional view taken along line 3—3 of FIG. 2.
Figure 4:
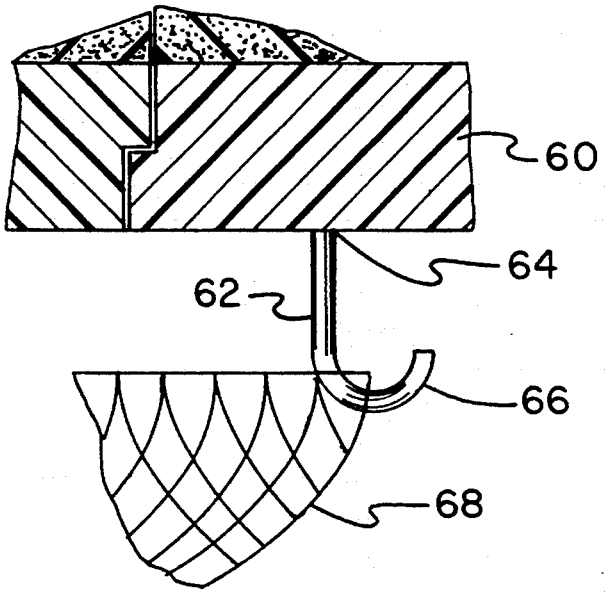
FIG. 4 is an enlarged side view of the support hooks of the present invention as seen in FIG. 3.

With reference now to the drawings, and in particular, to FIG. 1 thereof, the preferred embodiment of the new and improved jack relax relief lounger embodying the principles and concepts of the present invention and generally designated by the reference number 10 will be described.

Specifically, it will be noted in the various Figures that the device relates to a new and improved jack relax relief lounger providing the safest and most comfortable lounger for pregnant women. In its broadest context, the device consists of a first frame assembly, a second frame assembly, a third frame assembly, a support pad, a plurality of hooks, a pad cover, and a head rest.

The device 10 contains a first frame assembly 12 having a first end 14, a second end 16, an intermediate extent 18 therebetween, a lower surface 20, and an upper surface 22. A set of legs 24 are integral with both the lower surface 20 of the first end 14 and the lower surface 20.of the second end 16. A set of handles 26 are integral with the upper surface 22 of the intermediate extent 18. A first frame extension 28 is integral with the first end 14 of the first frame assembly 12. The extension 28 has a right support 30, a left support 32, and an intermediate support 34 therebetween. The first frame assembly 12 serves as the base element of the device 10. It is important that the material the first frame assembly 12 consists of, be a rigid plastic.

The device 10 contains a second frame assembly 36 having a first end 38, a second end 40, and an intermediate extent 42 therebetween. The first end 38 is pivotally secured to the first end 14 of the first frame assembly 12. The pivotal securement must be of a durable metal material that can be capable of withstanding both weather and everyday wear and tear.

The device 10 also contains a third frame assembly 44 having a first end 46, a second end 48, and an intermediate extent 50 therebetween. The first end 46 is pivotally secured to the intermediate extent 42 of the second frame assembly 36. A plurality of grooves 52 are along the intermediate extent 50. The grooves 52 optionally couple the third frame assembly 44 to the intermediate support 34 of the first frame assembly 12. The third frame assembly 44 serves to adjust the second frame assembly 36 from a horizontal position to a substantially vertical position in relation to the first frame assembly 12. The third frame 44 assembly essentially allows the user to choose from a variety of positions between a vertical position and a horizontal position. The ability to change the position of the third frame assembly 44 without trouble is also essential.

The first frame assembly 12, the second frame assembly 36, and the third frame assembly 44 together form a frame component 54. The frame component 54 should be of a light weight so as to allow the user the ease of moving the device about freely.

A support pad 56 is secured to the frame component 54. The support pad 56 has a circular recess 58 therethrough. The circular recess 58 must be large enough to comfortably receive the stomach of a pregnant woman. A reinforcing element 60 surrounds the circular recess 58. It is important that the material that composes the support pad 56 be of the most comfortable durable foam.

The device 10 contains a plurality of hooks 62 each having a first end 64 and a hooked second end 66. Each first end 64 is secured to thee reinforcing element 60 of the circular recess 58 of the support pad 56. A circular mesh support pouch 68 is removably secured to each second hooked end 66 of the plurality of hooks 62. The circular mesh support 68 is designed to provide support for a pregnant woman's stomach that is received through the circular recess 58 of the support pad 56.

A pad cover 70 is dimensioned to be received within the circular recess 58 of the support pad 56 and provide a flat surface. The pad cover is secured within the circular recess by a fastening means. The fastening means employed in this device is preferably a removable hook and loop type fastener adhesive strip. The pad cover 70 serves to transform the support pad 56 into a flat surface that can be enjoyed by those users who are not pregnant or for the pregnant woman to use to lie on her back or on her side.

The device contains 10 a head rest 72 having a plurality of straps 74 secured to the second end 40 of the second fame assembly 36. The plurality of straps 74 can be adjustable to allow for a variety of comfortable positions.

The present invention is designed especially for women who are carrying a child, and for other people, who for one reason or another, are not comfortable when they lie down on their stomach. Many pregnant women become tired of lying down on their backs, but due to their physical condition, they are prevented from laying face down. In addition to the discomfort that is inherent to the distended abdomen, attempting to lie on it could place a dangerous load on the baby. The present invention provides the safest and most comfortable lounger for pregnant women because it can be used like an ordinary unit, but whenever the expectant mother wishes, she can easily modify it so it will enable her to lie face down.

It features an oval shaped opening that is properly positioned to allow the user's stomach to protrude when lying face down. Reinforcement is provided around its rim, and a mesh pouch suspended below the opening absorbs some of the burden of the heavy load. For normal use, the opening is closed by placing a cover, made of the same material as the lounge cushion, over it. It is held in place with hook and loop fastening straps.

The present invention is ideal for use in virtually all environments in which a conventional lounge chair would be used. It can be made of the traditional materials which are used in lounge chair construction including aluminum, steel, wood, and plastic for the frames, and plastic or other synthetic fabrics.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved jack relax relief lounger providing the safest and most comfortable lounger for pregnant women comprising, in combination:

a first frame assembly having a first end, a second end, an intermediate extent therebetween, a lower surface, and an upper surface, a set of legs integral with both the lower surface of the first end and the lower surface of the second end, a set of handles integral with the upper surface of the intermediate extent, a first frame extension integral with the first end of the first frame assembly, the extension having a right support, a left support, and an intermediate support therebetween;

a second frame assembly having a first end, a second end, and an intermediate extent therebetween, the first end pivotally secured to the first end of the first frame assembly;

a third frame assembly having a first end, a second end, and an intermediate extent therebetween, the first end pivotally secured to the intermediate extent of the second frame assembly, a plurality of grooves along the intermediate extent, the grooves optionally coupling the third frame assembly to the intermediate support of the first frame assembly, the third frame assembly serving to adjust the second frame assembly from a horizontal position to a substantially vertical position in relation to the first frame assembly;

the first frame assembly, the second frame assembly, and the third frame assembly together forming a frame component;

a support pad secured to the frame component, the support pad having a circular recess therethrough, a reinforcing element surrounding the circular recess;

a plurality of hooks each having a first end and a hooked second end, each first end secured to the reinforcing element of the circular recess of the support pad, a circular mesh support pouch removably secured to each second hooked end of the plurality of hooks;

a pad cover dimensioned to be received within the circular recess of the support pad and provide a flat surface, the pad cover secured within the circular recess by a fastening means;

a head rest having a plurality of straps secured to the second end of the second fame assembly.

2. A new and improved jack relax relief lounger comprising, in combination:

a first frame assembly, a second frame assembly, and a third frame assembly together forming a frame component;

a support pad secured to the frame component, the support pad having a circular recess therethrough, a reinforcing element surrounding the circular recess;

a pad cover dimensioned to be received within the circular recess of the support pad and provide a flat surface, the pad cover secured within the circular recess by a fastening means;

a plurality of hooks each having a first end and a hooked second end, each first end secured to the reinforcing element of the circular recess of the support pad, a circular mesh support pouch removably secured to each second hooked end of the plurality of hooks.

* * * * *